United States Patent [19]

Lindqvist

[11] 3,937,006

[45] Feb. 10, 1976

[54] METHOD AND MEANS FOR OBTAINING STAPLES OR THE LIKE

[76] Inventor: Rolf Erik Lindqvist, Pionjargat. 50, 582 65 Linkoping, Sweden

[22] Filed: Dec. 10, 1973

[21] Appl. No.: 423,306

[30] Foreign Application Priority Data

June 9, 1972 Sweden ..... 7603/72

[52] U.S. Cl. ..... 59/76

[51] Int. Cl.[2] ..... B21D 53/46

[58] Field of Search ..... 59/76, 77, 71, 75

[56] References Cited

UNITED STATES PATENTS

| | | | |
|---|---|---|---|
| 287,087 | 10/1883 | Bayles | 59/76 |
| 322,372 | 7/1885 | Hanscom | 59/76 |
| 2,679,723 | 6/1954 | Marano | 59/76 |

*Primary Examiner*—C. W. Lanham
*Assistant Examiner*—Gene P. Crosby
*Attorney, Agent, or Firm*—Holman & Stern

[57] ABSTRACT

A machine is disclosed for producing staples or the like. A mat of wires is fed towards rotating discs, which at the same time cut and bend the wire mat to staples. The bending is performed over a fixed bar, where the mat is kept by an arm, and the cutting is performed by one fixed and one rotating knife. Many types of staples are obtainable, including naillike staples with sharp points.

8 Claims, 7 Drawing Figures

METHOD AND MEANS FOR OBTAINING STAPLES OR THE LIKE

BACKGROUND AND SUMMARY OF THE INVENTION

The present invention has as an object a method of obtaining staples or the like, whereon by which the length of the legs and the distance between the legs can be predetermined within wide limits. The present invention also relates, moreover, to the means for carrying into effect the method which has just been mentioned.

BRIEF DESCRIPTION OF THE DRAWINGS

The drawings, to which reference will be made in the following description, by way of non-limitative example, show an embodiment of the means to manufacture staples of the type mentioned.

In the drawings.

DESCRIPTION OF THE PREFERRED EMBODIMENTS

Figure 6:
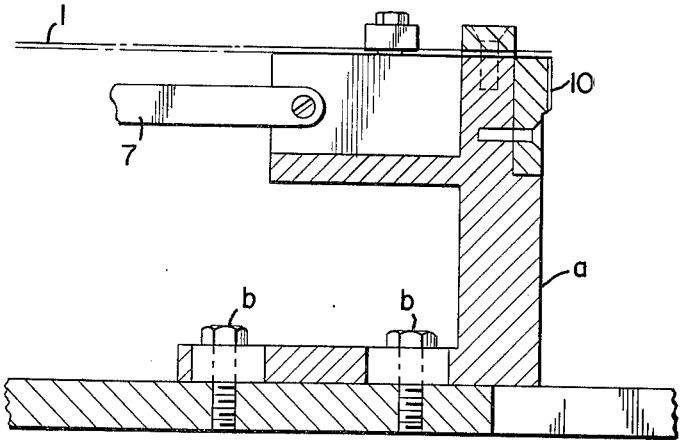
FIG. 6 shows an embodiment where the beater plate is movable in the longitudinal direction of the wire mat.

Referring to the drawings, there is shown a shaft 17 which is fitted in bearings 29 of steel mounted on a base plate 28. On the shaft 17 are mounted two discs 18, which rotate with the shaft 17. Between the discs 18 there is positioned a distance piece 25, which is in principle cylindrical. The discs 18 are provided with navenecks 30 and are kept pressed against the distance piece 25 by jamb nuts 31, which are threaded on shaft 17. Thus the discs 18 could be exchanged, if a bearing 29 is removed. On the discs 18 there are made mutually congruent sectorformed cavities 32. Parallel to the shaft 17, a mat or strip 1 of wires in a plane, which wires adhere to each other, e.g. by the aid of some adhesive, is fed by a feeding member 7, which is per se known. Member 7 feeds the mat or strip 1 stepwise towards a cutting member 9,10, and the length of the steps could be predetermined. The cutting member 9,10 comprises a beater plate 10, which is arranged perpendicular to the longitudinal direction of the mat or strip 1, which is also its direction of movement. FIG. 6 shows an embodiment where a bracket a is movable in the direction of the wire mat by tightening screws b. The cutting member 9,10 also comprises an overhang beater 9, which is attached to, but in an exchangeable way, to disc 18, and more exactly to the disc which is nearest to the beater plate 10. The beater 9 is fitted to the side on the rear edge of the sectorformed cavity 32, in the rotation direction, and is directed to the beater plate 10. A bar 3 is horizontally arranged perpendicular to the shaft 17, with its upper edge higher than the centre line of shaft 17. The width of bar 3 is so much less than the width of the distance piece 25, as double the thickness of mat or strip 1. It is arranged to extend between the discs 18, nearly to the distance piece 25. In the middle in front of the beater plate 10 its upper side is formed like a shallow, in the cross-section dull V-formed groove 2, whose legs extend to the sides of the bar 3, which are mutually parallel. A plate 8, with the same thickness as the width of the bar 3 is arranged between the discs 18, is pivoted on a trunnion 20, which is parallel to the shaft 17, and is arranged behind this on the same level. The plate 8 extends above and below the shaft 17, and its portion, which extends above the shaft 17 reaches the far end edge of the beater plate 10, across the bar 3. The plate 8 is is provided with cam sufaces 21,22 in the middle above and below the shaft 17, said cam surfaces 21,22 being arranged to cooperate with a ridge 23 which is attached to the distance piece 25 in the following way: A short moment before the overhang beater 9 starts to cut a portion of the mat or strip 1, which has been fed across the bar 3, the lower cam surface presses the plate 8 downwards in a way, that its portion, which extends across the bar 3, which is equipped with a jaw 34 is pressed against the mat or strip 1. The lower side of jaw 34 is formed, in the cross section, like a ridge as a blunt V, the angle of which is less than the angle of the groove 2, which means that the jaw 34 presses the central portion 5 of the cut portion down in the groove 2 a short moment before the overhang beater 9 cuts the mat or strip 1. As soon as the portion of the mat has been cut off, the edges of the discs 18, which are provided with hardened, bent bending bars 11,12, bend the legs 4, which are mutually of the same length, of the portion of the mat 1 which projects across the bar 3, downwards along the parallel sides of the bar 3. The ridge 23 of the distance piece is designed in a way to keep the jaw 34 pressed against the central portion 5 of the mat portion until the bending is completed.

Figure 1:
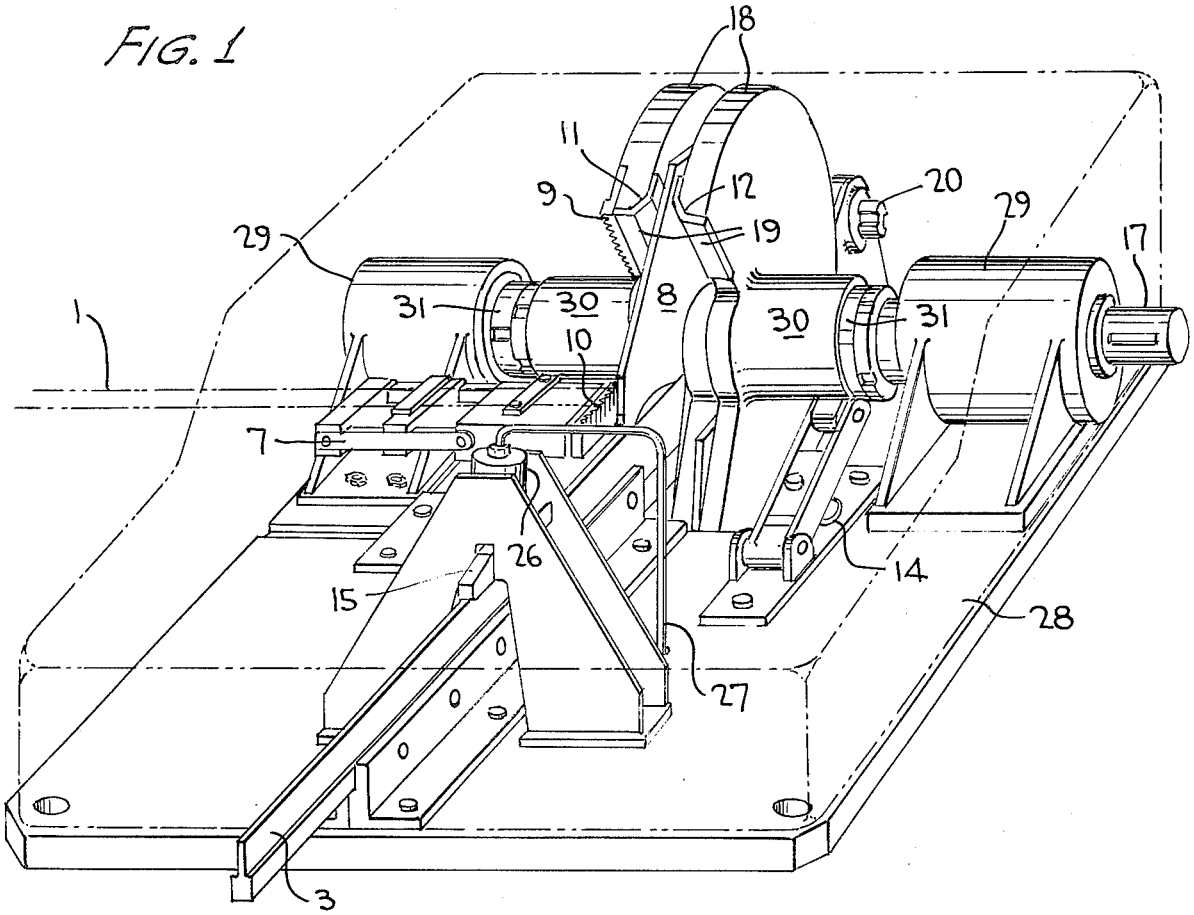
FIG. 1 shows an embodiment of means for carrying into effect the method according to the present invention.

The discs 18 are, on their sides which are facing each other, equipped with mutually congruent, helical expelling surfaces 13. The ridge 23 is so arranged, that when the expelling surfaces are just hitting the bent legs 4 of the mat portion, the pressure of the jaw 34 on the central portion 5 of the mat portion is reduced thus making it possible for this piece to be moved along the bar 3. When it has been moved away, the ridge 23 will hit the upper cam surface of the plate 8 and thus lift the plate 8 with the jaw 34, to make it possible to put in a new portion of wire mat under the jaw 34. The legs 4 of the portion of wire mat, which has been moved away diverge somewhat towards their free ends because of the resilience of the wire material. A little further away on the bar 3 there is provided press equipment. This is formed as a bar 15, which is arranged along and above the bar 3. The length of the bar 15 is somewhat longer than the width of the mat or strip 1. The lower side of the bar 15 is formed like a shallow, blunt V-formed groove 33, whose angle is somewhat less than the angle of the groove 2, which groove 33 is arranged to cooperate with a ridge 6 with a cross-section like a blunt V, whose angle is somewhat greater than that of the groove 33, which ridge 6 is attached to the upper side of the bar 3. This means that the bar 15, when it is pressed downwards by a servo motor 26, presses the ends of the central portion 5 of the wire mat portion downwards, which causes the the legs 4 to be bent somewhat inwardly into cavities 16 in the sides of the bar 3. When the bar 15 is thereafter lifted, the legs 4 will bend out by the resilience of the wire material, to make the legs parallel. The servomotor 26 might be electromagnetic, but is preferably as is shown on FIG. 1 a single acting hydraulic cylinder which is connected by a tube 27 to a preferably cylinderformed sensing member, arranged to be acted upon directly or indirectly by a ridge (not shown), on the naveneck 30 of the disc 18. It has proved to be convenient to design the trunnion 20 as an eccentric, to make it possible to predetermine the level of the plate 8 and the distance of the jaw 34 from the shaft 17.

Figure 2:
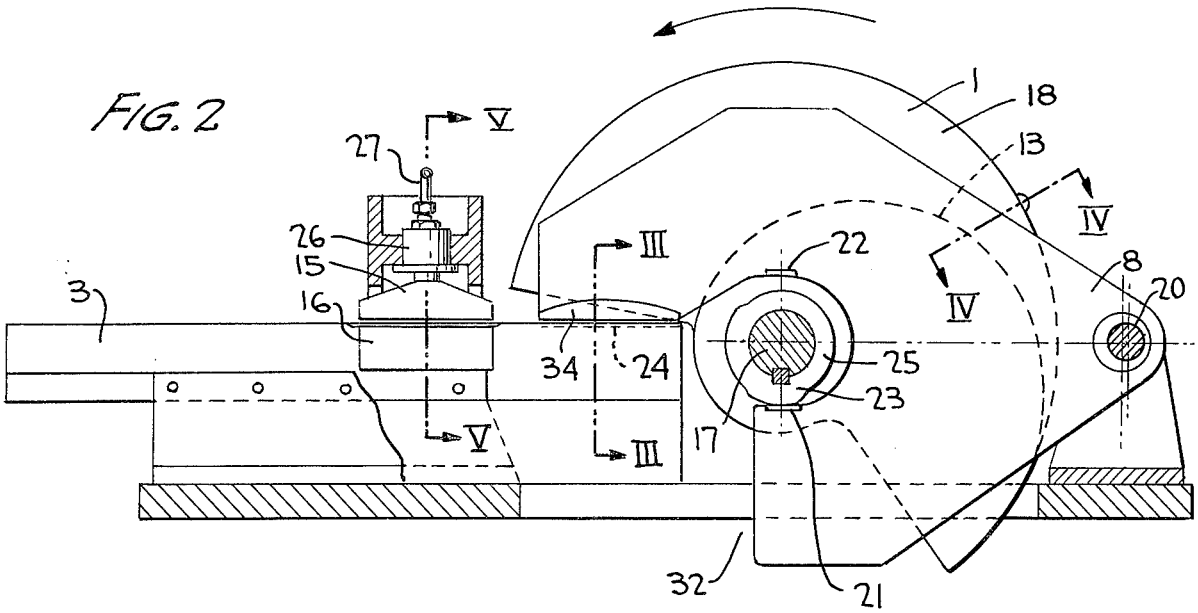
FIG. 2 shows the same embodiment, seen from one side, partly in cross section, with the bending plate removed.
Figure 3:
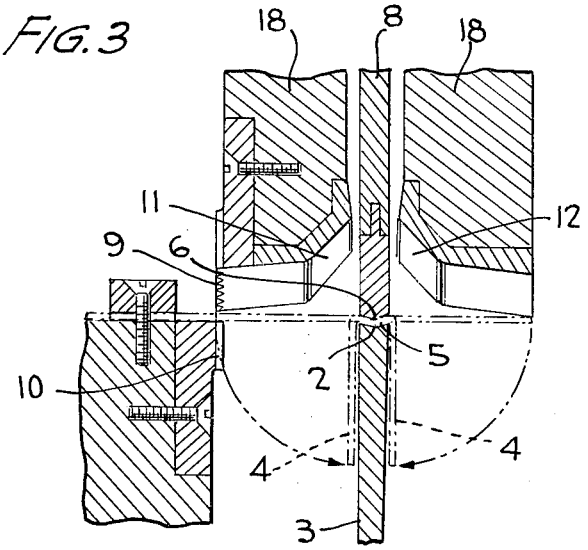
FIG. 3 shows a section along line III—III of FIG. 2.
Figure 4:
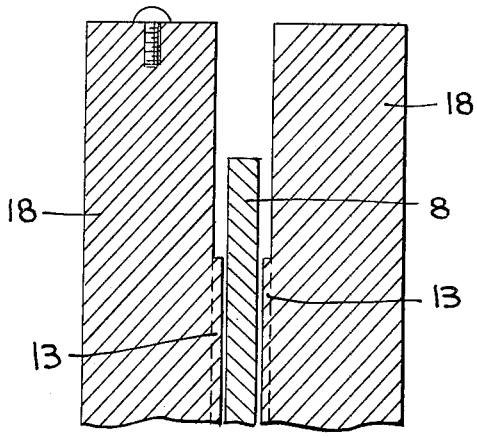
FIG. 4 shows a section along line IV—IV of FIG. 2.
Figure 5:
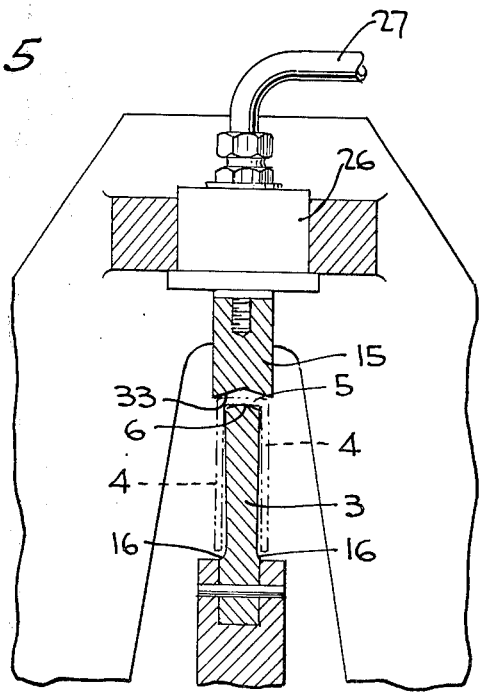
FIG. 5 shows a section along line V—V of FIG. 2.
Figure 7:
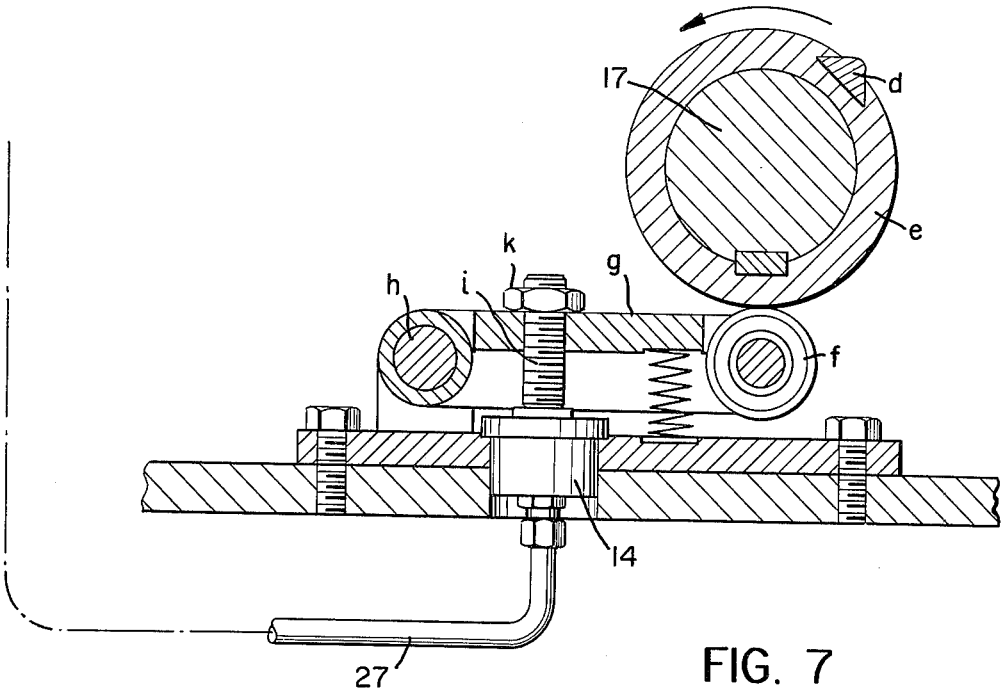
FIG. 7 shows a hydraulic sensing member.

There is a sensing member 14 (FIGS. 1 and 7) which operates as follows and is clearly seen in FIG. 7:

A cam d operates a cam-following pulley f on a lever g, which is swingable on a shaft h and by a screw i through the lever g acts on the sensing member 14, which may be an electric switch (not shown) but is shown as a hydraulic transmitting cylinder 14, which by suitable piping 27 is connected with the servo-motor 26 (FIGS. 1 and 5), acting on the thus synchronized pressing member 15 (FIGS. 2 and 5). The screw i is adjustable and lockable by a locking nut k.

I claim:

1. A method to produce staples with parallel legs comprising the following steps:

arranging a plurality of wires of desired cross section in a side-by-side relationship in a plane and adhering the wires to each other to form a mat or strip, moving the mat or strip which is obtained stepwise in the longitudinal direction of the wires, the length of the steps being chosen as desired, cutting off the portion of the mat which has been moved in this way from the rest of the mat while the central portion of said portion is kept fixed, and is given a somewhat concave, blunt V-shaped bending on the upper side, bending the side legs of the cut portion of the mat downwards, principally to mutual parallel positions, moving the cut and bent portion of the mat along a bar, pressing both ends of the central portion of the bent portion of the mat downwards over a ridge, shaped as a blunt V, to make its leg to converge towards their free ends, and interrupting the pressing when the legs have achieved a position, from which they will become parallel by the resilience of the material.

2. Apparatus for producing staples with parallel legs wherein:

a feeding member, is arranged to feed, in a stepwise manner and in predetermined, desired steps, a mat of wires, arranged so as to adhere to each other in a plane, comprising a keeping member, arranged to press down a central portion of a mat portion fed in stepwise manner into a shallow, V-shaped groove, on the upper side of a bar which is arranged perpendicular to the movement direction of the wire mat, cutting members, comprising a fixed lower beater plate and an overhang beater, which is fixed, substantially radially, to a circular disc which is attached to and rotating with a shaft, bending members, which are designed as bent bending surfaces, each of the bending members being attached to a respective disc, which rotates with a rotating shaft, and being substantially radially arranged on said discs, said bending members being arranged to bend down both legs of the cut portion of the mat over said bar, expelling members, designed as cam surfaces, arranged on the sides of the rotating discs, which face each other, and arranged to expel the adhering mat of staples which has been formed, along the bar, a pressing member, arranged above said bar and arranged to press both ends of the central portion of the formed mat of staples against the edges of a ridge, bluntly V-shaped, which is arranged below the pressing member, along the upper side of said bar, to make the legs of the staple mat to be pressed into cavities in the sides of said bar, said pressing member being arranged to work in a synchronous manner with said rotating shaft.

3. Apparatus according to claim 2, said cutting members having said lower beater plate located on a higher level than the rotating shaft, to make the overhang beater work scissorlike.

4. Apparatus according to claim 2, said lower beater plate is arranged to be movable in the longitudinal direction of the wire mat.

5. Apparatus according to claim 2, said overhang beater is arranged to be exchangeable, the different overhang cutting blades being of different width, to make them able to cut portions of different length of the wire mat as they are cooperating with the movable lower beater plate.

6. Apparatus according to claim 2, said pressing member being arranged to be operated by a singleaction hydraulic servo-motor, which is connected by a relatively wide tube to a hydraulic sensing member, which is arranged to be acted upon, directly or indirectly, by a ridge attached to the rotating shaft.

7. Apparatus according to claim 2, said keeping member being designed as a plate, which is arranged between said rotating discs, pivoted on a trunnion, which is parallel to said rotating shaft, said trunnion being attached adjacent to the discs and extends in a direction which is opposed to said bar, said plate extending across said rotating shaft and at least as far across said bar as which relates to the width of said wire mat, said plate being equipped with cam surfaces in the middle, below and above said rotating shaft, and arranged to be acted upon by a ridge which is attached to said rotating shaft in such a way that the ridge, acting upon the lower cam surface, will press a contact surface, arranged on the plate centally above said bar, against a central portion of the wire mat, which has been put in under said contact surface, and, when said ridge acts upon the upper cam surface, will lift the plate and the contact surface, to make it possible to position a new portion of the wire mat under the contact surface.

8. Apparatus according to claim 7, said ridge is arranged to start to act upon a lower cam surface shortly before the overhang beater starts to cut the wire mat, and keeps the contact surface pressed against the wire mat with a pressure, which will continuously be reduced during about a quarter of a revolution.

* * * * *